United States Patent [19]

Davenport et al.

[11] 4,151,445

[45] Apr. 24, 1979

[54] INSTANT LIGHT LAMP CONTROL CIRCUIT

[75] Inventors: John M. Davenport, Lyndhurst, Ohio; Michael N. Diamond, Grandview, Ind.

[73] Assignee: General Electric Company, Schenectady, N.Y.

[21] Appl. No.: 878,054

[22] Filed: Feb. 15, 1978

[51] Int. Cl.[2] ..... H05B 41/24; H05B 41/46

[52] U.S. Cl. ..... 315/92; 315/87; 315/219

[58] Field of Search ..... 315/86–88, 315/92, 93, 91, 136, 219; 307/38, 39

[56] References Cited

U.S. PATENT DOCUMENTS

| | | | |
|---|---|---|---|
| 3,517,254 | 6/1970 | McNamara, Jr. | 315/91 |
| 3,693,045 | 9/1972 | Price | 315/87 X |
| 3,737,720 | 6/1973 | Willis | 315/91 |
| 4,005,331 | 1/1977 | Horowitz | 315/92 |

FOREIGN PATENT DOCUMENTS

| | | | |
|---|---|---|---|
| 377937 | 5/1964 | Switzerland | 315/92 |
| 444305 | 9/1967 | Switzerland. | |

*Primary Examiner*—Eugene R. LaRoche
*Attorney, Agent, or Firm*—Ernest W. Legree; Lawrence R. Kempton; Frank L. Neuhauser

[57] ABSTRACT

An instant light lamp combining a miniature arc tube and a standby filament in a sealed vitreous envelope is operated by a high frequency power supply combined with a filament control circuit. The power supply comprises transforming means including voltage sensing means having an output proportional to the drop across the arc tube. The control circuit comprises an electronic switch for energizing the filament and a comparator circuit which has an output gating on the switch when the sensing means output is either above a high limit or below a low limit.

8 Claims, 2 Drawing Figures

INSTANT LIGHT LAMP CONTROL CIRCUIT

The invention relates to an instant lighting lamp combining a miniature arc tube with a standby filament and is more particularly concerned with high frequency circuits for ballasting such arc tube and switching the standby filament on and off to achieve instant lighting.

BACKGROUND OF THE INVENTION

In copending application Ser. No. 845,738, filed Oct. 26, 1977 by Elmer G. Fridrich, titled "Miniature High Pressure Discharge Lamps", similarly assigned, useful and efficient high pressure discharge lamps are disclosed having much smaller sizes than have been considered practical heretofore, namely discharge volumes of one cubic centimeter or less. In preferred form achieving maximum efficacy, these high intensity lamps utilize generally spheroidal thin-walled arc chambers together with vapor pressures above 5 atmospheres and reaching progressively higher levels as the size is reduced. The convective arc instability usually associated with the high pressures utilized is avoided and there is no appreciable hazard from possibility of explosion. Practical designs provide wettage ratings or lamp sizes starting at about 100 watts and going down to less than 10 watts, the lamps having characteristics including color rendition, efficacy, maintenance and life duration making them suitable for general lighting purposes.

High pressure metal vapor lamps have certain inherent shortcomings which persist even in miniature sizes. One of these is the delay in achieving full brilliance after ignition, caused by the need to heat up the envelope and vaporize the metallic fill. This delay may be termed the cold start delay. Another is the even longer delay, termed the hot restart delay, which occurs should there be momentary interruption of power to the lamp. The lamp then becomes extinguished and relighting will not occur immediately upon restoration of power. It is necessary firstly for the lamp to cool down and the metal vapor pressure to diminish before the ballast can restrike the arc, and then more time is required for the lamp to heat up to full brilliance.

It is known to use a separate standby incandescent lamp in combination with a discharge lamp and a control circuit to supplement the light from the discharge lamp during its off or low illumination periods and thereby achieve instant light. Such a system is disclosed in Swiss patent No. 377,937 (Leuenberger, 1964) in which the standby lamp is energized by a relay whose winding receives two oppositely directed voltages derived from the circuit of a mercury vapor lamp. During the cold start interval and also during the hot restart interval, the vector difference of the two voltages is large enough to energize the relay and switch on the standby lamp. During normal operation, the vector difference is too small to energize the relay so that the standby lamp is switched off. Another example is described in Swiss patent No. 444,305 (Vogeli, 1967) wherein the relay is replaced by a silicon controlled rectifier connected in series with the standby lamp across a power supply. Yet other examples are disclosed in U.S. Pat. No. 3,517,254 (McNamara Jr., 1970) which uses a voltage breakdown device such as a diac connected in series with the standby lamp to control the current flow through it, the diac and the standby lamp being connected in parallel with the discharge lamp; and in U.S. Pat. No. 3,737,720 (Willis, 1973) which uses a pair of relays to assure that the standby incandescent lamp is automatically turned on at cold start or at hot restart.

A characteristic of the miniature high pressure metal vapor lamps with which the invention is particularly concerned is the very rapid deionization to which they are subject. In operation on 60 Hz alternating current, deionization is almost complete between half cycles so that a very high restriking voltage is required to be provided by the ballast. Particularly in metal halide lamps during the lamp warm-up interval, the reignition voltage reaches extremely high levels in the first few seconds after arc ignition. Due to these deionization limitations associated with low frequency operation of miniature metal vapor lamps, recourse is being had to high frequency ballasts operating in resonance-free regions in the range of 20 to 50 kHz. In these regions the miniature lamps are not subject to destructive acoustic resonances and stable operation is possible as taught in copending application Ser. No. 864,578 filed Dec. 27, 1977, by John M. Davenport titled "High Frequency Operation of Miniature Metal Vapor Discharge Lamps", assigned to the same assignee as the present invention. The type of circuit favored for such high frequency operation, frequently termed an inverter, in general comprises a power oscillator with current-limiting means coupled to the miniature lamp. The control circuits known to the art for assuring instant light with a discharge lamp by means of an associated auxiliary incandescent lamp or filament are not well suited to the high frequency ballasting circuits favored for miniature high pressure metal vapor lamps.

One object of our invention is to provide an instant light lamp combining a miniature arc tube with a standby filament for providing light immediately when the lamp is switched on. Another object is to provide a ballast and control circuit particularly suitable for high frequency operation of an arc tube together with electronic switching of the filament to achieve instantaneous lighting whether at a cold start or at a hot restart.

SUMMARY OF THE INVENTION

In accordance with our invention, the operating and control circuit for an instant light lamp combining a miniature high intensity arc tube and a standby filament comprises a high frequency power supply and a filament control circuit. Acccording to one aspect of our invention, the power supply includes transforming means operating at a frequency in the range of 20 to 50 kilohertz having an output circuit across which the discharge lamp is connected and means for limiting the current flow in said output circuit. The filament control circuit comprises electronic switching means for turning on the filament, voltage sensing means in said transforming means having an output proportional to the voltage across the arc tube, and a voltage comparator circuit which provides an output signal for gating on the switching means when the sensing means voltage is either below a predetermined low level or above a predetermined high level. Thus the filament is energized to achieve instant lighting whether at a cold start or at a hot restart of the arc tube in the lamp.

In a preferred embodiment wherein a blocking oscillator is used for the power supply, the transformer of the blocking oscillator comprises a primary winding, a secondary winding across which the miniature arc tube or discharge lamp is connected, an auxiliary feedback winding and a current sensing winding. Depending upon current flow in the discharge lamp, the sensing winding will cause one or the other, or neither, of two zener diodes to break down and thereby gate on or off an SCR which controls energization of the auxiliary filament.

DETAILED DESCRIPTION

Figure 1:
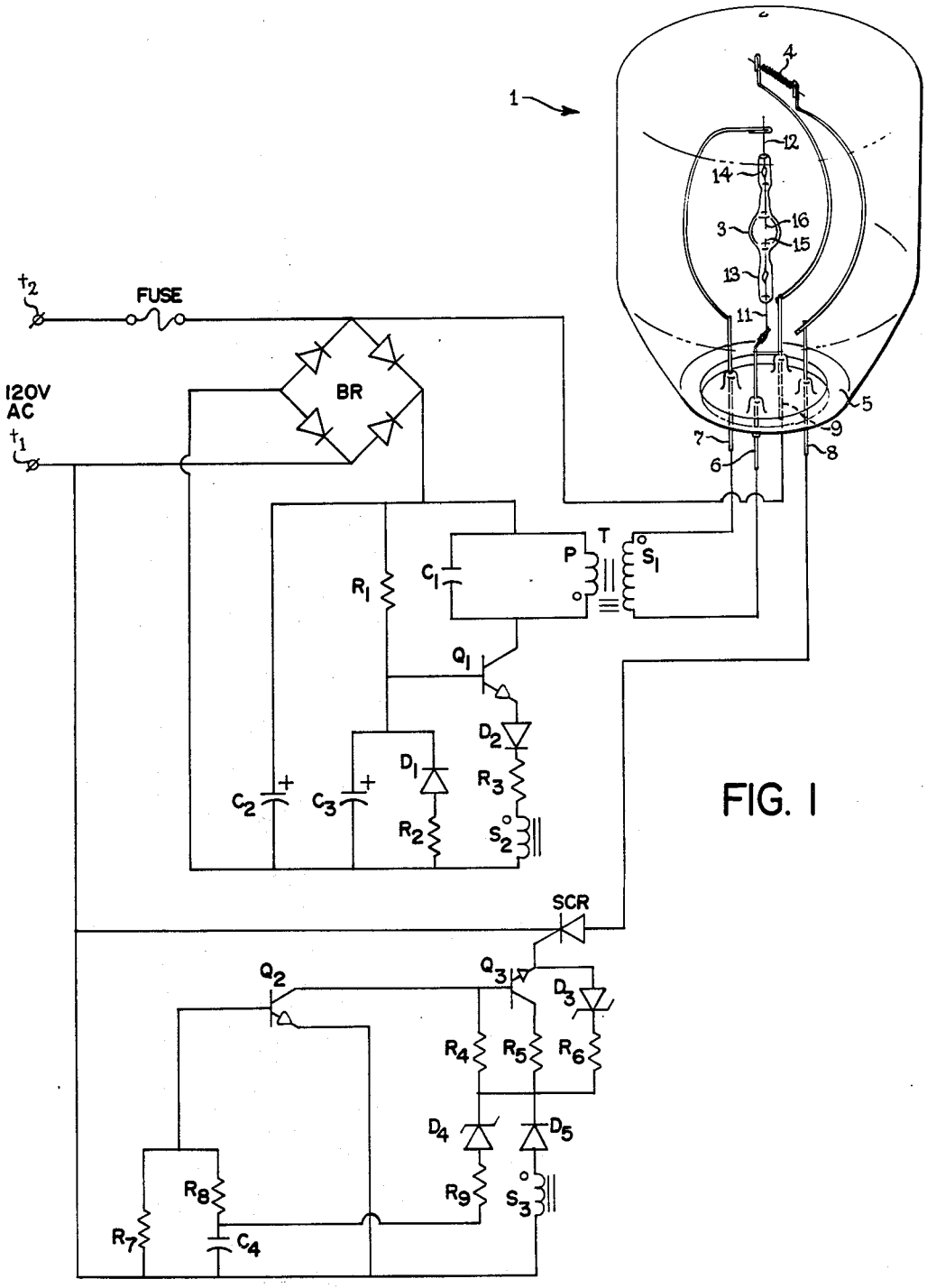
FIG. 1 shows pictorially a jacketed lamp containing a miniature high intensity discharge arc tube and an auxiliary incandescent filament, and schematically a high frequency ballast and control circuit therefor embodying the invention.

Referring to FIG. 1, an instant light lamp 1 combining a discharge source and a standby filament is illustrated for which the control circuit of the invention is particularly suited. It comprises an outer glass envelope or jacket 2 within which are mounted an inner envelope or arc tube 3 and a tungsten filament 4. The outer envelope is provided at its lower end with a disc-like glass closure 5 through which extend hermetically four inleads. Inleads 6 and 7 and their extensions support arc tube 3 in a vertical or axial attitude approximately at the center of the outer envelope. Inleads 8 and 9 and their curved extensions support filament 4 in a horizontal or transverse attitude above the arc tube. The space within the outer envelope may be filled with an inactive gas such as nitrogen to prevent oxidation of the filament or of the fine inleads 11, 12 emerging from the arc tube. Alternatively, the space within the outer envelope may be evacuated if desired in order to reduce the heat loss from the arc tube.

The arc tube 3 is typical of the discharge envelope proper of a miniature metal halide lamp. It is made of quartz or fused silica, suitably by the expansion and upset of quartz tubing while heated to plasticity. The neck portions 13, 14 may be formed by allowing the quartz tubing to neck down through surface tension. In the illustration, the wall thickness of th bulb portion is about 0.5 mm, the internal diameter is about 6 mm, and the arc chamber volume is approximately 0.11 cc. Pin-like electrodes 15, 16 of tungsten are positioned on the axis of the arc tube with their distal ends defining an interelectrode gap of 3 mm in this example. The pins are joined to inlead portions 11, 12 by foliated portions, preferably of molybdenum, which are wetted by the fused silica of the necks to assure hermetic seals. By way of example, a suitable filling for a lamp of this size having a rating of about 30 watts comprises argon at a pressure of 100 to 120 torr, 4.3 mg of Hz, and 2.2 mg of halide salt consisting of 85% NaI, 5% $ScI_3$ and 10% $ThI_4$ by weight. Such quantity of mercury, when totally vaporized under operating conditions, will provide a density of about 39 mg/cm$^3$ which corresponds to a pressure of about 23 atmospheres at the operating temperature of the lamp.

In order to avoid the reignition problems due to the very rapid deionization to which miniature metal vapor lamps are subject, it is desirable to operate the lamp by means of a high frequency ballast at a frequency within the range from 20 to 50 kHz. Such circuits in general comprise a power oscillator with current limiting means coupled to the lamp, that is to the arc tube proper. Typical circuits use solid state control devices and ferrite core transformers or inductors; they may be made compact enough for direct attachment to the lamp at the utilization point, that is at the electrical outlet or socket or may be integrally joined to the lamp to make a so-called screw-in unit. Such a unit comprising a miniature metal vapor arc tube and an auxiliary filament enclosed within an outer envelope, plus a ballast control unit integrally joined to the outer envelope and provided with screw-base terminals, may be screwed into a conventional Edison socket as a direct replacement for an ordinary household type incandescent lamp.

Blocking Oscillator

The example of a compact high frequency ballasting circuit schematically illustrated in FIG. 1 is an inverter in the form of a blocking oscillator. A full wave four diode bridge rectifier BR connected across 120 volt, 60 Hz line or input terminals $t_1$, $t_2$ provides rectified d.c. power to drive the inverter. Filter capacitor $C_2$ connected across the bridge's output terminals provides sufficient smoothing action to avoid reignition problems due to line frequency modulation of the high frequency output. A ferrite core transformer T comprises a primary winding P, a secondary high voltage winding $S_1$, a feedback winding $S_2$, and a sensing winding $S_3$. Though spaced apart in the drawing, all the windings are magnetically linked and the winding sense is conventionally indicated by a dot at the appropriate end of the windings. The leakage reactance between primary and secondary is also conventionally indicated by lines transverse to the principal core lines. The primary winding P, the collector-emitter path of transistor $Q_1$, and the feedback winding $S_2$ all connected in series form the principal primary current path. In that path $R_3$ is a current limiting resistor and diode $D_2$ provides reverse current protection for transistor $Q_1$. Resistors $R_1$ and $R_2$, diode $D_1$ and capacitor $C_3$ provide base drive for this transistor. The secondary high voltage winding is connected to inleads 6, 7 leading to arc tube 3.

The operation of the blocking oscillator may be summarized as follows: whenever the collector current is less than the gain times the drive of switching transistor $Q_1$, the transistor is saturated, that is it is fully on and acts like a switch. The collector current then is limited by the inductance of transformer windings P and $S_2$. As the collector current rises and approaches a value equal to the gain times the base current drive, the transistor begins to come out of saturation. This serves to reduce the voltage across $S_2$ which in turn reduces the base drive and through regenerative action turns transistor $Q_1$ off. Regeneration occurs after the field collapses in primary winding P. This returns the circuit to its initial condition so that the cycle may repeat, thereby providing a high frequency drive for the lamp connected across secondary winding $S_1$. A preferred operating frequency for the 6 mm i.d. spheroidal lamp which has been described is about 26.5 kHz. This frequency corresponds to the first design window above the catastrophic A band described in the previously mentioned Davenport patent application.

Filament Control Circuit

Filament 4 across inleads 8, 9 is connected in series with electronic switching means in the form of silicon-controlled rectifier SCR, across 120 volt 60 Hz line terminals $t_1$, $t_2$. The filament is energized when the SCR is gated on, at which time the current flow consists of unidirectional half sine waves. Since the effective or rms voltage of half sine wave voltage is $1/<2$ (or 0.707) that of the corresponding full wave voltage, this permits the use of a more rugged lower voltage filament for the supplementary lighting function. However, if this is not desired, the SCR may be replaced by a triac, that is by a bidirectional silicon-controlled rectifier and the filament will then be energized by conventional alternating current at line voltage.

Figure 2:
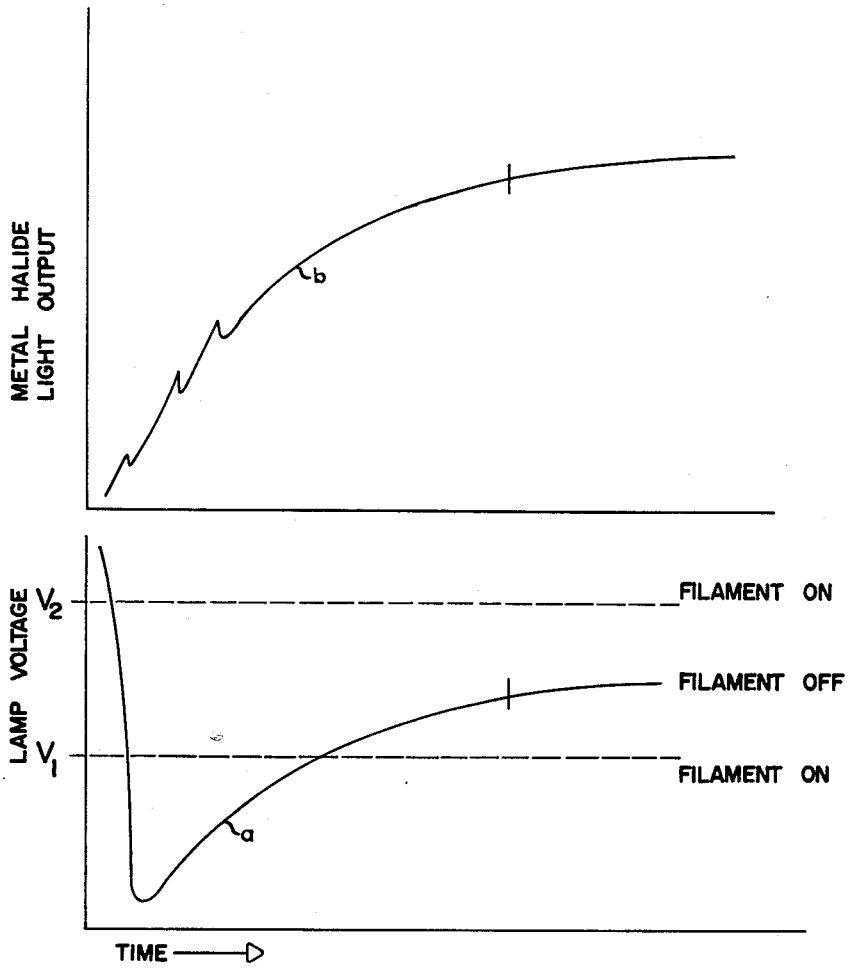
FIG. 2 is a graph illustrating light output, voltage and current conditions of the miniature discharge lamp at various times.

When the ballasting circuit is first turned on, the voltage across the arc tube is high prior to ignition, falls precipitously upon ignition, and then rises gradually to the operating level as illustrated by curve a in FIG. 2. The light output from the metal halide lamp is represented by curve b; it starts at 0 and rises to its operating level, the three minor peakings in the curve being due to the vaporization of the several metallic halides contained in the fill as the temperature of the lamp envelope passes through the boiling point of each one. This sequence and the low light level as the arc tube heats up may be referred to as the cold start delay. If a momentary power outage should occur, even for only a few cycles, the rapid deionization characteristics of the arc tube would cause it to extinguish. The arc tube would then have to cool for as much as one-half minute or more until the vapor pressure had decreased to the point where the applied voltage could reignite the arc. During this time interval, the voltage across the arc tube is high but there is no current through it and the light output is nil. Then immediately after reignition, the light output is low until the arc tube heats up again. This entire sequence may be referred to as the hot restart delay. During both the cold start and the hot restart delays when there is little or no light from the arc tube, the voltage across it is either above level $V_2$ or below level $V_1$ in FIG. 2. At such times the filament control circuit associated with sensing winding $S_3$ functions to gate on the SCR and switch on the standby filament.

The filament control circuit comprises two zener diodes $D_3$ and $D_4$ connected in a comparator circuit receiving the output $V_s$ of sensing winding $S_3$. Zener diode $D_3$ has a breakdown level which the sensing winding output voltage exceeds only prior to ignition of the arc tube, that is during the cooling down stage of a hot restart. Zener diode $D_4$ has a lower breakdown level which is exceeded prior to ignition and during normal operation of the arc tube but not during its warm-up period. The voltage $V_s$ generated by sensing winding $S_3$ is generally proportional to the voltage across the arc tube but need not be linearly proportional. The comparator circuit may be considered an electronic amplifier having a transfer characteristic providing a signal when $V_s$ is either greater than $V'_2$ or less than $V'_1$, where $V'_1$ and $V'_2$ are the voltages $V_1$ and $V_2$ transformed in the same ratio as was the voltage across the arc tube to give $V_s$. When there is an output signal, current flows through the gate of the SCR and the filament is turned on. But when $V_s$ falls between $V'_1$ and $V'_2$, there is no output signal and the filament is turned off.

In operation, the voltage output of sensing winding $S_3$ is rectified by diode $D_5$ to provide drive for a control circuit including transistor $Q_3$ which gates the SCR. Before breakdown or ignition in the arc tube, the voltage output $V_s$ of the sensing winding is high and breaks down zener diode $D_3$ (24 volts in this example). This applies drive directly to the gate of the SCR, which in turn energizes the filament to provide instant light at a hot restart. Zener diode $D_4$ will also break down but that is of no consequence at this time. After the arc tube has cooled down sufficiently, ignition occurs. At that moment the voltage output $V_s$ of the sensing winding drops to such a low value that neither zener diode $D_3$ nor zener diode $D_4$ conducts. Under these conditions there is enough drive present through the base of transistor $Q_3$ to turn it on. This in turn will provide gate drive to the SCR and energize the filament to provide instant light at a cold start or during the post-ignition warming-up stage of a hot restart. As the arc tube approaches normal operating temperature, $V_s$ increases to the point where it is sufficient to break down zener diode $D_4$. When such happens, the base of $Q_2$ is held positive with respect to its emitter by reason of the current flow through $D_4$, $R_9$, $R_8$ and $R_7$. Transistor $Q_2$ then conducts and lowers the voltage at the base of transistor $Q_3$ with respect to its emitter. $Q_3$ is thus held off, the gate drive to the SCR is removed and the filament is extinguished while the arc tube operates normally.

In the described circuit, the SCR may, of course, be replaced by some other form of semi-conductor controlled rectifier or electronic switch. Other comparator circuits having a like transfer characteristic and capable of operating in the frequency range from 20 to 50 kHz may be substituted for that which has been illustrated and described in detail. Our invention thus provides a compact high frequency circuit for energizing a high pressure metal vapor discharge lamp which includes a control circuit for a standby filament assuring instant light when switched on irrespective of the prior condition of the discharge lamp.

What we claim as new and desire to secure by Letters Patent of the United States is:

1. In combination, an instant-light lamp comprising a high pressure miniature metal vapor arc tube and an incandescible filament mounted within a sealed vitreous envelope, ballasting means having input terminals and comprising a source of electrical energy having a frequency between 20 and 50 kilohertz, transforming means in said source including an output circuit across which the arc tube is connected, said ballasting means including means for limiting the current flow in said output circuit, and a filament control circuit comprising electronic switching means interposed between said terminals and said filament, and means for gating on said switching means comprising voltage sensing means in said transforming means having an output proportional to the voltage across the arc tube, and a voltage comparator circuit providing an output for gating on said switching means when the sensing means voltage is either below a predetermined low level or above a predetermined high level.

2. The combination of claim 1 wherein said voltage comparator circuit is an electronic amplifier having a transfer characteristic providing an output for gating on said switching means when the sensing means voltage is either below the low level or above the high level, and providing no output when the sensing means voltage is between the low and high levels.

3. The combination of claim 1 wherein said source of electrical energy is a lower oscillator including a transformer having a primary winding, a feedback winding, and a secondary winding across which the arc tube is connected in an output circuit which includes reactance for limiting the current flow, and the voltage sensing means is a winding in said transformer having an output proportional to the voltage across said lamp.

4. The combination of claim 1 wherein said source of electrical energy is a power oscillator including a transformer having a primary winding, a feedback winding, and a secondary winding across which the arc tube is connected in an output circuit which includes reactance for limiting the current flow, the voltage sensing means is a winding in said transformer having an output proportional to the voltage across said lamp, and the voltage comparator circuit is an electronic amplifier having a transfer characteristic providing an output for gating on said switching means when the sensing winding voltage is either below the low level or above the high level, and providing no output when the sensing means voltage is between the low and high levels.

5. The combination of claim 1 wherein said electronic switching means is a semi-conductor controlled rectifier or a tirac.

6. The system of claim 1 wherein said electronic switching means is a semi-conductor or controlled rectifier or a triac.

7. An instant-light system comprising in combination:

a high intensity discharge lamp, an auxiliary incandescible filament, ballasting means having input terminals and comprising a power oscillator including a transformer having a primary winding, a feedback winding, and a secondary winding across which the discharge lamp is connected in an output circuit which includes reactance for limiting the current flow, and a filament control circuit comprising switching means interposed between said terminals and said filament, and means for gating on said switching means comprising a voltage sensing winding in said transformer having an output proportional to the voltage across said lamp, and a voltage comparator circuit providing an output for gating on said switching means when the sensing winding voltage is either below a predetermined low level or above a predetermined high level.

8. A system as defined in claim 7 wherein said voltage comparator circuit includes a pair of zener diodes of which one has a higher breakdown voltage than the other, neither zener diode conducting when the output voltage of the sensing winding is below the low level, only the lower breakdown voltage zener diode conducting when said output voltage is between said low and high levels and both zener diodes conducting when said output voltage is above said high level, said comparator circuit providing current to gate on said switching means when neither or both of said zener diodes is conducting but providing no gate current when only the lower breakdown voltage zener diode is conducting.

* * * * *